US005664745A

United States Patent [19]

Hadaway

[11] Patent Number: 5,664,745

[45] Date of Patent: Sep. 9, 1997

[54] MUSICAL BABY BOTTLE ADAPTER

[76] Inventor: Sharon Hadaway, 133 McCabe Crescent, Thornhill, Ontario, Canada, L4J 2S6

[21] Appl. No.: 649,907

[22] Filed: May 15, 1996

[51] Int. Cl.[6] ..... A47D 15/00

[52] U.S. Cl. ..... 248/105; 248/102; 215/11.1

[58] Field of Search ..... 248/102, 103, 248/104, 105, 106; 215/11.1, 11.6, 400

[56] References Cited

U.S. PATENT DOCUMENTS

| | | | |
|---|---|---|---|
| 3,627,161 | 12/1971 | Wergeland | 215/11.1 |
| 4,678,093 | 7/1987 | Allen | 215/11.1 |
| 4,944,704 | 7/1990 | Grace | 215/11.1 X |
| 5,312,282 | 5/1994 | Cooper | 215/11.1 X |
| 5,344,034 | 9/1994 | Eagan | 215/11.1 |
| 5,536,196 | 7/1996 | Sternberg | 215/400 X |

*Primary Examiner*—Alvin C. Chin-Shue
*Assistant Examiner*—Richard M. Smith

[57] ABSTRACT

The present invention provides for a baby bottle adapter for releasable attachment to the bottom of the baby bottle, the adapter being capable of playing a musical melody when activated. The adapter includes a top chamber of a size and shape to accept the bottom of a baby bottle, the top chamber being formed from a side wall and a bottom provided by an internal divider located with the adapter. The adapter also has a bottom chamber located below the top chamber, the bottom chamber being sealed against liquid infiltration and containing means for playing a musical melody upon activation. The bottom chamber is formed from the side wall and the internal divider of the adapter and a base attached to the bottom of the adapter. The base is provided with an opening through which an activating means passes, the activation means having a contact surface for contact and activation of the means for playing the musical melody, the activating means being surrounded by an elastomeric sealing material which extends beyond the opening on either side of the base surrounding the opening to seal the opening against infiltration of liquid into the lower chamber.

3 Claims, 1 Drawing Sheet

MUSICAL BABY BOTTLE ADAPTER

FIELD OF THE INVENTION

The present invention relates to an adapter for a baby bottle which is capable of playing a musical tune.

BACKGROUND OF THE INVENTION

There have been many articles and toys which have been developed for babies which are capable of playing a musical tune such as a lullaby to help sooth the baby. Examples of such articles are mobiles and other activity toys.

In addition, an adapter for a baby bottle has been developed which is attachable to a baby bottle and which is capable of playing a musical tune. This prior holder or attachment for the baby bottle does have the drawbacks of not being child safe, in that, it has certain small parts which a child could remove and could swallow. In addition, this prior holder is not dishwasher safe.

SUMMARY OF THE INVENTION

The present invention provides for a baby bottle adapter for releasable attachment to the bottom of the baby bottle, the adapter being capable of playing a musical melody when activated. The adapter includes a top chamber of a size and shape to accept the bottom of a baby bottle, the top chamber being formed from a side wall and a bottom provided by an internal divider located with the adapter. The adapter also has a bottom chamber located below the top chamber, the bottom chamber being sealed against liquid infiltration and containing means for playing a musical melody upon activation. The bottom chamber is formed from the side wall and the internal divider of the adapter and a base attached to the bottom of the adapter. The base is provided with an opening through which an activating means passes, the activation means having a contact surface for contact and activation of the means for playing the musical melody, the activating means being surrounded by an elastomeric sealing material which extends beyond the opening on either side of the base surrounding the opening to seal the opening against infiltration of liquid into the lower chamber.

BRIEF DESCRIPTION OF THE DRAWINGS

Preferred embodiments of the present invention is illustrated in the attached drawings, wherein.

DETAILED DESCRIPTION OF THE PREFERRED EMBODIMENTS

Figure 1:
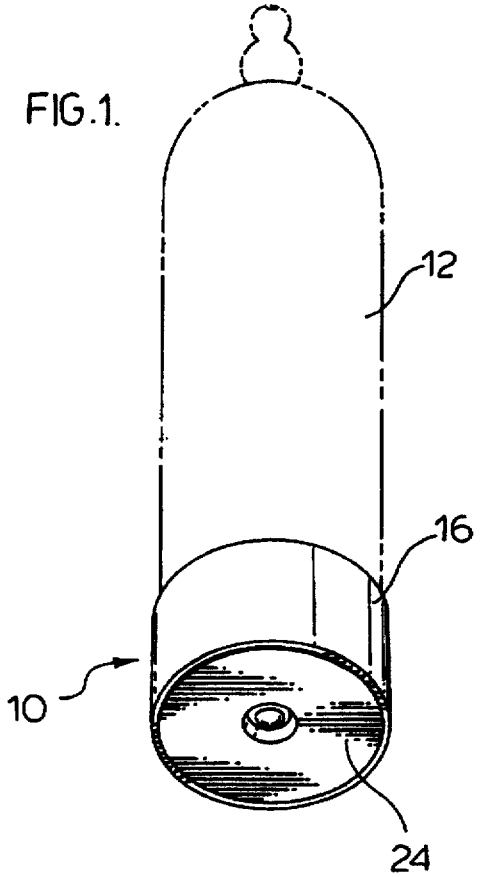
FIG. 1 is a perspective view of the adapter of the present invention.
Figure 2:
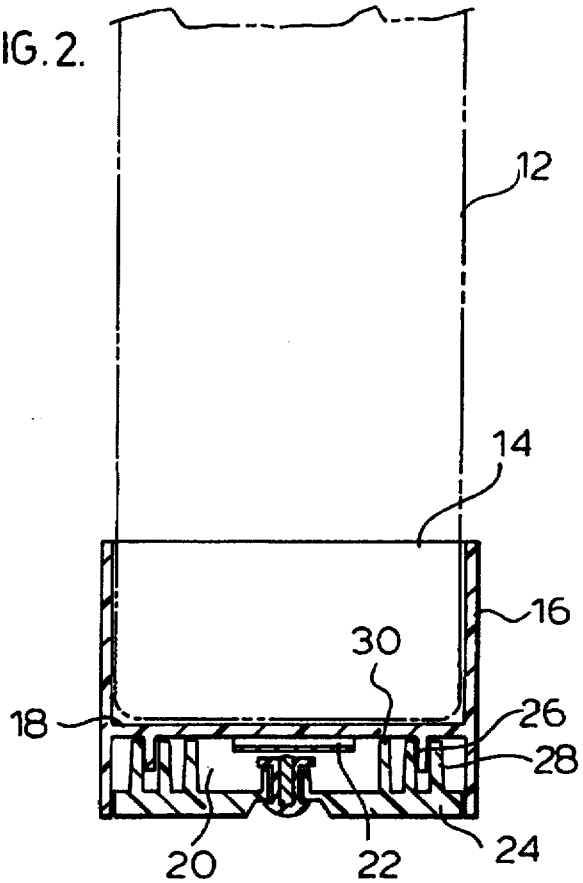
FIG. 2 is a side view in cross-section of the adapter of FIG. 1.
Figure 3:
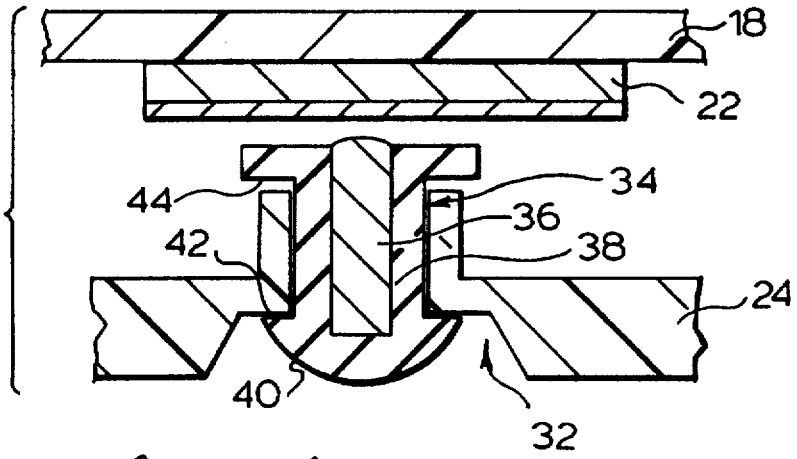
FIG. 3 is an exploded view of the activating button of the adapter of FIG. 1.

A preferred embodiment of the baby bottle adapter of the present invention is illustrated in the attached Figures, generally indicated by the number 10. The baby bottle adapter 10 is shaped to slide over the end of a typical baby bottle 12 shown in outline in FIGS. 1 and 2. As most baby bottles 12 are cylindrical in shape, baby bottle adapter 10 is provided with a top chamber 14 preferably as an open ended cylinder having an opening of a size to accept the base of typical baby bottles. While most bottles are cylindrical as shown in the Figures, other shapes are common and the shaping of the top chamber can be adapted to fit other such bottle shapes. Top chamber 14 is formed by the side 16 of the baby bottle adapter 10 and an internal divider 18 which provides a cup-like portion for accepting the base of the baby bottle 12.

Internal divider 18 is located spaced away from the hollow bottom chamber. musical melody 22. Such means for generating a musical melody are commercially available and generally include a power means, a circuit means containing the instructions and data for the melody encoded and stored in suitable memory devices and a sound means for audibly reproducing the stored and encoded melody.

Bottom camber 20 is closed off by means of a base 24 which may be secured to the bottom in part by means of complementary guides 26 and 28 provided on the lower surface of the internal divider 18 and surface of the base 24 interior to the chamber respectively. To maintain the correct spacing of the base 24 to allow for proper operation of the musical melody component 22, base 24 may be provided with spacer legs 30 which, when the base 24 is attached to the side 16 and internal divider 18, butt against the divide 18 to provide for the proper spacing.

In order to make the baby bottle adapter 10 water tight, the base 24 is glued or sealed along its peripheral edges where it contacts the sides 16. This sealing prevents water from leaking into the bottom chamber 20 when washing the holder to prevent potential damage to the musical melody components 22.

Base 24 is provided a central recess 32 having an opening into the bottom chamber 20, the opening accepting an activating button 34 for activation of the musical melody component 22. Activating button 34 has a electrically conductive core 36 which, when it makes contact with the musical melody component 22, closes an electrical circuit to activate the musical melody component 22. The electrically conductive core 36 is surrounded by and sealed in the opening by means of a flexible elastomeric material 38 preferably made from a suitable elastomeric polymer such as a silicone rubber or other such material. The flexible elastomeric material 38 is preferably provided having an external dome-shape 40 and is provided with sealing surfaces 42 and 44 which rest against the top and bottom surfaces of the opening through which the activating button passes.

Figure 4:
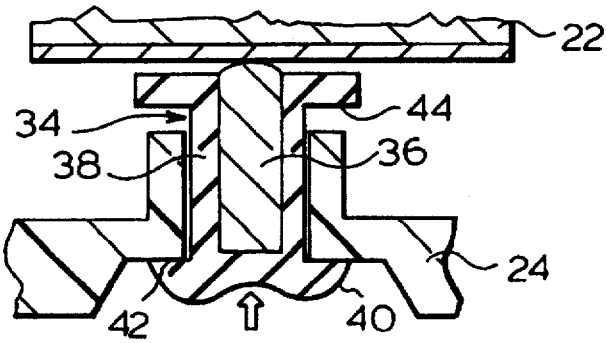
FIG. 4 is a view of the activating button in operation.

In operation, as illustrated in FIG. 4, as pressure is placed on the dome 40, the electrically conductive core 36 of the activating button 34 is pressed inwardly until it contacts the contact area on the musical melody component 22. Owing to the elastomeric properties of the sealing material 38, a tight seal is maintained against the surface of the recess surrounding the opening during this operation.

The provision of the structure of the activating button 34 of the baby bottle adapter 10 of the present invention provides for numerous benefits. The provision of the elastomeric material 38 surrounding the electrical core 36 having sealing surfaces resting against both the top and bottom surfaces of the opening ensures that the opening will be sealed against water being able to enter the bottom chamber 20 through this opening, thus making the baby bottle adapter 10 dishwasher safe. In addition, the provision of the sealing surfaces 42 and 44 against both the top and bottom surface of the opening as well as the provision of the dome-shape of the top of the activating button 34 ensures that the button is very difficult to remove from the opening as the sealing surface 44 provides for a stop surface to prevent the button 34 from easily being pulled out. In addition, the dome-shaped top does not provide for any surface which can be easily gripped for pulling the button out of the opening. This feature makes the baby bottle adapter 10 more child proof as it is difficult, if not impossible, for a child to be able to pull the button 34 from the opening so that it may be swallowed.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A baby bottle adapter for releasable attachment to a bottom of a baby bottle, the adapter being capable of playing a musical melody when activated, the adapter comprising, a hollow top chamber of a size and shape to accept the bottom of a baby bottle, the top chamber being formed from an upper portion of a perimetric side wall and an internal divider located within the adapter, a hollow bottom chamber located below the top chamber, the hollow bottom chamber being sealed against liquid infiltration and containing a means for playing a musical melody upon activation, the hollow bottom chamber being formed from a lower portion of the perimetric side wall, the internal divider of the adapter, and a base having an upper and lower surface attached to the lower portion of the perimetric side wall below the internal divider, the base being provided with an opening through which an activating means having a contact surface for contact and activation of the means for playing the musical melody passes, the activating means being surrounded by an elastomeric sealing material which extends beyond the opening on both the upper and lower surfaces of the base surrounding the opening to seal the opening against infiltration of liquid into the bottom chamber.

2. A baby bottle adapter as claimed in claim 1 wherein the elastomeric sealing material is provided with an external dome shape.

3. A baby bottle adapter as claimed in claim 2 wherein the elastomeric sealing material is silicone rubber.

* * * * *